United States Patent [19]

Stefani

[11] Patent Number: 4,717,105

[45] Date of Patent: Jan. 5, 1988

[54] SWADDLING TABLE

[76] Inventor: Samuel Stefani, Leitenweg 21, D-8071 Wettstetten, Fed. Rep. of Germany

[21] Appl. No.: 933,291

[22] Filed: Nov. 20, 1986

Related U.S. Application Data

[63] Continuation of Ser. No. 696,163, Jan. 29, 1985, abandoned.

[51] Int. Cl.[4] ..... A47F 1/10

[52] U.S. Cl. ..... 248/295.1; 4/572; 211/103; 248/311.2

[58] Field of Search ..... 248/295.1, 297.3, 125, 248/132, 311.2; 108/108, 110, 146; 4/571, 572; 211/103, 208, 107, 112

[56] References Cited

U.S. PATENT DOCUMENTS

| | | | |
|---|---|---|---|
| 625,271 | 5/1899 | Lang | 211/103 X |
| 2,544,615 | 3/1951 | Raymond | 108/146 |
| 3,078,484 | 2/1963 | Briggs | 248/297.3 X |
| 3,109,177 | 11/1963 | Grafmyer | 248/295.1 X |
| 4,348,989 | 9/1982 | Vik | 248/125 X |

FOREIGN PATENT DOCUMENTS

| | | | |
|---|---|---|---|
| 111888 | 12/1983 | European Pat. Off. . | |
| 1494198 | 7/1967 | France | 248/295.1 |

*Primary Examiner*—J. Franklin Foss
*Assistant Examiner*—David L. Talbott
*Attorney, Agent, or Firm*—Dority & Manning

[57] ABSTRACT

The invention relates to a swaddling table for swaddling babies having a horizontal swaddling plate which is movable relative to a vertical, round guide rail. The swaddling plate is connected to bushing which surrounds the guide rail. To support the swaddling plate, there is a retention device which comprises bores or recesses along the guide rail and a lever piece connected to the bushing. The lever piece is pivotable about a horizontal axis and is pre-stressed towards the bores or recesses by means of a spring. The lever piece carries an extension which can engage into the bores and which has an approximately horizontal surface towards the bottom and a run-in slope towards the top.

1 Claim, 2 Drawing Figures

SWADDLING TABLE

This a continuation of application Ser. No. 696,163 filed Jan. 29, 1985 which was abandoned upon the filing hereof.

FIELD OF THE INVENTION

The invention relates to a swaddling table for swaddling babies according to the pre-characterizing clause (preamble) of the claim.

BACKGROUND OF THE INVENTION

A swaddling table of the applicant is already known German Offenlegungsschrift No. 3,246,566) and in this a horizontal swaddling plate is movable on a vertical guide rail. Here, the swaddling plate can be moved from a lower working position into an upper, higher position of rest. When this swaddling-table arrangement is attached above a bath tub, it is guaranteed that the bathroom space is utilized efficiently. When the swaddling plate is raised, the bath tub can be used without obstruction. When the swaddling plate is in the lower working position, on the other hand, it can be used conveniently for the bodycare of a baby. To retain this swaddling plate in the lower working position or the upper position of rest, an actuating handle is provided on the front underside of the swaddling plate. In a preferred embodiment, tubes can be extended laterally on the swaddling plate telescopically, so that a baby's bath tub can be inserted and held between them.

The known swaddling table ensures that the space in a bathroom is utilized efficiently. However, the proposed embodiment of the guide rail and of the retention mechanism can be produced only at a very high outlay, and it is rather complicated to handle. Also, the appearance of the known swaddling table is not very elegant.

In contrast to this, the object of the invention is to design the known swaddling table so that while having a pleasing appearance, the swaddling table can be produced more cheaply and handled more easily.

This object is achieved by means of the features of the claim.

SUMMARY OF THE INVENTION

According to the claim, the guide rail has a round diameter. The guide rail is surrounded by a bushing which can slide off the guide rail. The horizontal swaddling plate is connected firmly to the bushing, so that the swaddling plate can be moved up and down on the guide rail. However, the swaddling plate on the bushing is also rotatable relative to the round guide rail. This provides the possibility for a simple and elegant solution for a retention device. The retention device consists of at least two bores in the round guide rail in the region of the lower working position and the upper position of rest. However, there is preferably a continuous row of bores in the guide rail, so that it is also possible to select all the intermediate positions for the swaddling plate. A lever piece connected to the bushing can engage into these bores. The lever piece is pivotable about a vertical axis and pre-stressed towards the bores by means of a spring. The lever piece can engage into the bores by means of an extension which has a surface directed approximately horizontally towards the bottom and a run-in slope towards the top.

When the swaddling plate is raised or pushed upwards the lever piece is pressed out of the bore because of its run-in slope, and the swaddling plate can be moved upwards. When the next bore is reached, the extension on the lever piece engages therein again. Because of the horizontal lower surface of the extension, the plate is supported at the bottom and prevented from slipping back. On the other hand, when the swaddling plate is to be moved downwards, it is raised slightly so that the extension of the lever piece is moved out of the bore. The swaddling plate or the bush is subsequently rotated somewhat relative to the guide rail, so that, when the swaddling plate is pushed downwards, the extension of the lever piece no longer comes in contact with the bore located underneath. Only when the desired (lower) height is reached is the swaddling plate and consequently the extension of the lever piece rotated into the region of a bore and engaged there.

This is a very simple method of handling, since there is no need for any additional actuating and retaining levers. Production is simple and economical, and at the same time, the swaddling table operates smoothly.

According to the claim, the guide rail will carry on the two end faces pipe clips for wall fastening. The pipe clips must be designed so that the guide rail projects from the wall to such an extent that the bushing can slide unimpeded on it.

According to the claim, the guide rail will contain a continuous row of bores (from top to bottom), so that it is possible for the swaddling plates to assume appropriate intermediate positions. A continuous row of bores also has an attractive visual appearance.

According to the claim, after fastening the bores will point forwards. This makes it easier for the swaddling plate or the extension on the lever piece to be engaged, since the bores are clearly visible.

In a preferred design according to the claim, a stand for receiving a child's bath tub is attached to the swaddling plate. Consequently, the swaddling plate and the child's bath tub are located directly next to one another at approximately the same convenient working height and form a practical unit for carrying out babycare.

The claim indicates appropriate production features.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
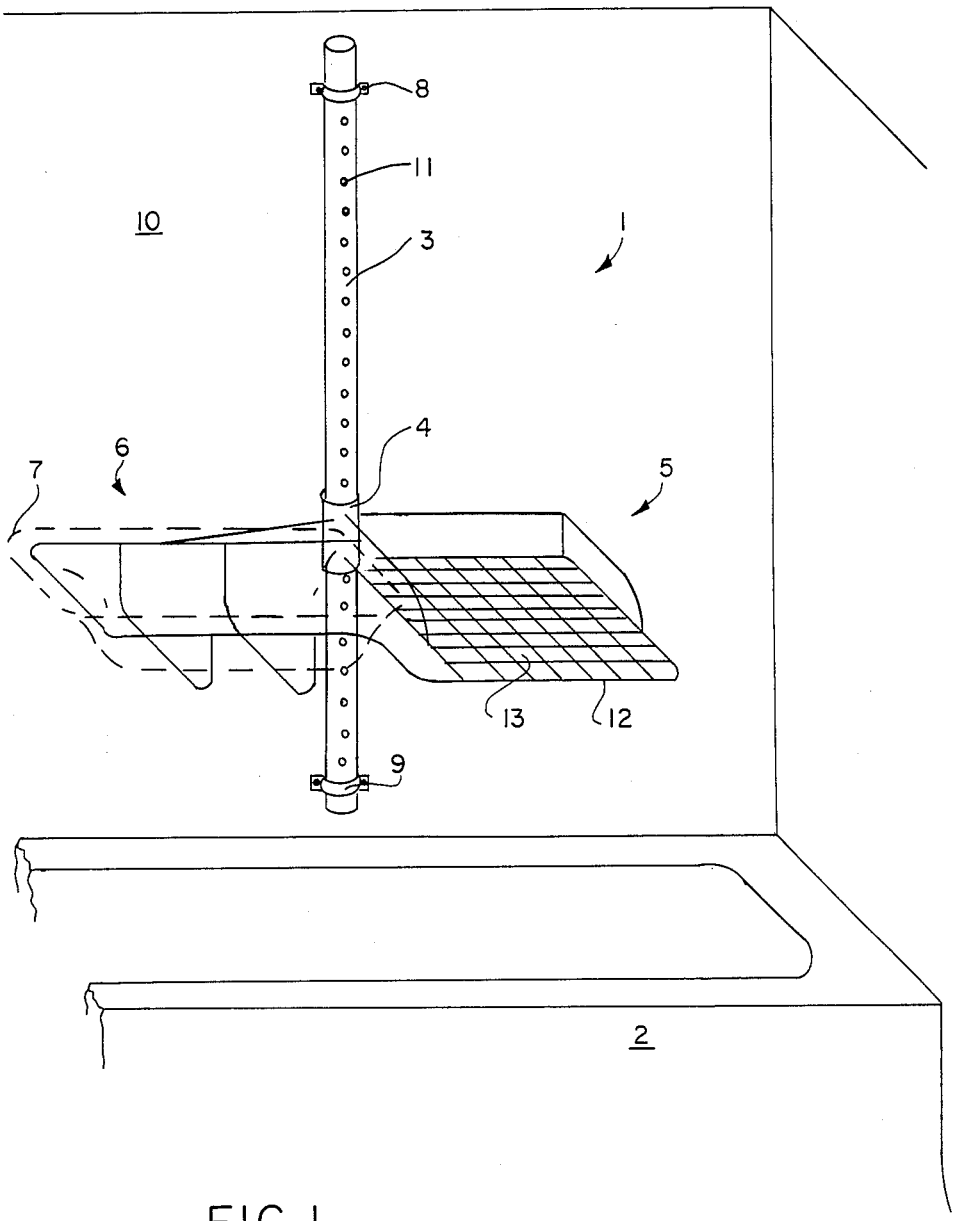
FIG. 1 shows a swaddling table with a swaddling plate, bath tub stand and guide rail mounted above the bath tub.

In FIG. 1, a swaddling table 1 is attached above a bath tub 2. The swaddling table 1 consists of a guide rail (guide tube) 3, a sliding bushing 4, a swaddling plate 5 and a bath tub frame 6. A child's bath tub 7 is marked by broken lines in the bath tub frame 6. The guide tube 3 is fastened to a wall 10 behind the bath tub 2 by means of two pipe clips 8, 9 vertically and at a distance from the wall 10. The guide tube 3 has bores 11 off-set in the longitudinal direction.

Figure 2:
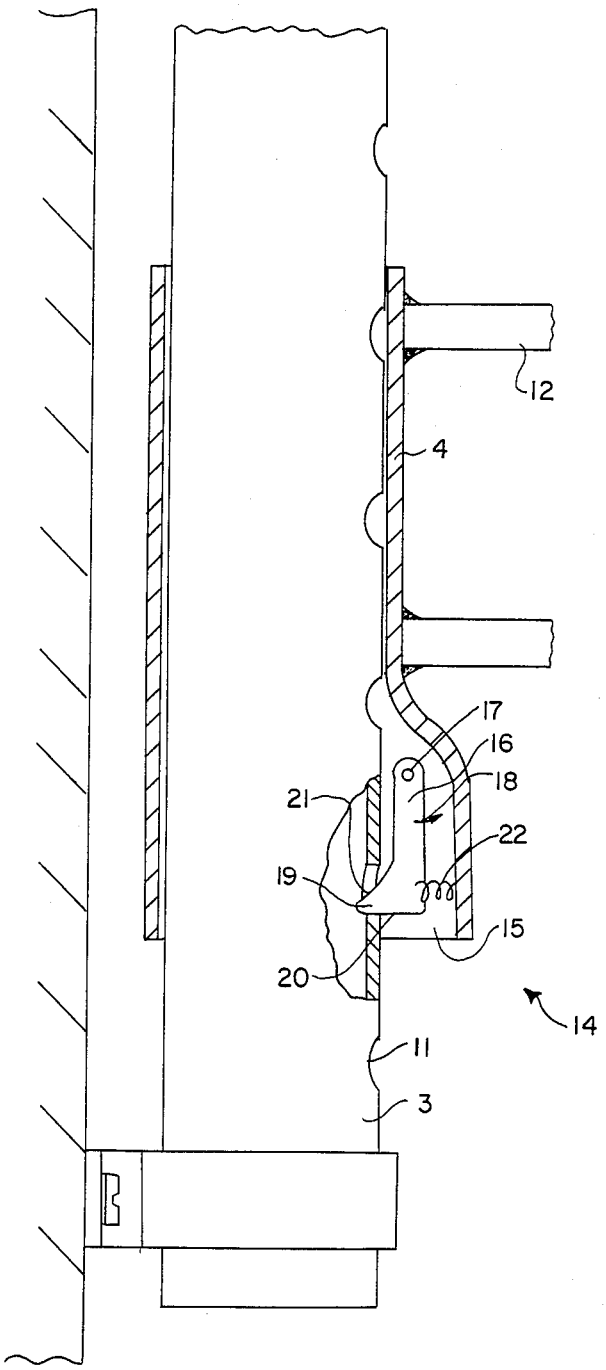
FIG. 2 shows a section through the bushing of the the swaddling table to illustrate the retention device.

The sliding bushing 4 can be displaced and retained along the guide tube 3 (the retention device is illustrated in FIG. 2). A frame 12 formed from round-iron bars and intended for the swaddling plate 5 is connected to the sliding bushing 4. The frame 12 is covered with strips of fabric 13. The frame 12 is arranged on the right of the guide tube 3, while the bath tub stand 6 is arranged on the left and is likewise connected to the sliding bushing 4 and to the frame 12. The child's bath tub 7 is inserted easily into the bath tub stand 6 and held by the shackles of the bath tub stand 6. The child's bath tub 7 can easily be emptied into the large bath tub 2 located under it when one side is lifted.

FIG. 2 illustrates in detail the retention device 14. For this purpose, the bushing 4 and part of the guide tube 3 as shown in section. Parts of the frame 12 which project to the right are shown on the bushing 4.

The bushing 4 is widened somewhat on the underside and shaped out into a small housing 15. A lever piece 16 pivotable about a horizontal axle 17 (see the arrow 18 for pivoting direction) is inserted in the housing 15. The lever piece 16 carries, in the section of the bores 11, an extension 19 which has a horizontal surface 20 towards the bottom and a run-in slope 21 towards the top. A helical spring 22 which pre-stresses the lever piece 16 of the extension 19 in the direction of the bores 11 is inserted between the housing wall 15 and the lever piece 16.

The design illustrated operates as follows:

When the swaddling plate 5 is to be moved upwards into its position of rest from its lower (engaged) working position, it is simply pushed upwards along the row of bores 11. As a result, because of the run-in slope 21, the lever piece 16 or the extension 19 is always forced out of the particular bore 11 which comes next. In the desired position of rest, the swaddling plate is engaged into the appropriate bore 11 by means of the extension 19. When the swaddling plate 5 is to be moved from the top downwards, it is raised first so that the lever piece 16 is disengaged. Subsequently, the bushing and therefore the lever piece 16 are rotated sideways out of the region of the bores 11. The swaddling plate can thereby be moved downwards, without the lever piece 16 being able to engage into a bore 11. Only when the desired lower position is reached are the swaddling plate and consequently the lever piece 16 rotated back into the region of the bores 11 again, so that the lever piece 16 is engaged and the swaddling plate 5 and the bath tub stand 6 are retained.

It will be understood, of course, that while the form of the invention herein shown and described constitutes a preferred embodiment of the invention, it is not intended to illustrate all possible forms of the invention. It will also be understood that the words used are words of description rather than of limitation and that various changes may be made without departing from the spirit and scope of the invention herein disclosed.

I claim:

1. A swaddling table for swaddling babies having a horizontal swaddling plate which can be moved from a lower working position upwards to a position of rest, comprising:

(a) a guide rail perpendicualr to the swaddling plate, said guide rail being round;

(b) a sliding bushing surrounding the guiding rail and fixedly connected to the swaddling plate, said bushing carrying the swaddling plate, and said bushing being vertically displaceable on the guide rail;

(c) retention means fixedly attached to said swaddling plate for movement therewith and received within a portion of said bushing for securing the swaddling plate in said working and in said rest positions, said retention means releasing automatically upon a substantially vertical upward force being applied to the swaddling plate to allow substantially non-tilting upward movement of the swaddling plate with respect to said guide rail, said retention means automatically re-securing the swaddling plate upon the swaddling plate being moved upwards a predetermined distance along said guide rail, said retention means including:

(i) at least two engagement recesses in the guide rail in the region of the height of said working position and rest position, each of said at least two engagement recesses having a lower engagement surface;

(ii) a horizontal axle connected to the bushing;

(iii) a lever mounted to pivot about said horizontal axle;

(iv) an extension carried by said lever, said extension pointing towards said engagement recesses and being mounted to engage into said recesses, said extension having a run-in slope towards the top and an approximately horizontal surface towards the bottom, said approximately horizontal surface being for engaging said lower surface of one of said at least two engagement recesses for substantially supporting the swaddling plate on said lower surface through contact therewith; and (v) spring means for pre-stressing the lever towards the engagement recesses, whereby, when the extension is engaged in a recess, upward movement of the swaddling plate will force the extension out of engagement with the recess, and the action of the spring means will force the extension into the next recess thereby securing the swaddling plate in the next position as desired.

* * * * *